US007746364B2

(12) United States Patent
Shen et al.

(10) Patent No.: US 7,746,364 B2
(45) Date of Patent: Jun. 29, 2010

(54) BRIGHTNESS CORRECTION METHOD AND SYSTEM UTILIZING THE SAME

(75) Inventors: Chang-Han Shen, Hsinchu (TW); Chih-Fu Yang, Changhua (TW)

(73) Assignee: Getac Technology Corporation, Hsinchu (TW)

( * ) Notice: Subject to any disclaimer, the term of this patent is extended or adjusted under 35 U.S.C. 154(b) by 1041 days.

(21) Appl. No.: 11/313,887

(22) Filed: Dec. 20, 2005

(65) Prior Publication Data

US 2006/0284898 A1 Dec. 21, 2006

(30) Foreign Application Priority Data

Jun. 17, 2005 (TW) ..... 94120156 A

(51) Int. Cl.
*G09G 5/10* (2006.01)

(52) U.S. Cl. ..... 345/690; 345/89

(58) Field of Classification Search ..... 345/63, 345/77, 88, 89, 98, 690, 207; 348/674, 675, 348/E5.074, E9.054
See application file for complete search history.

(56) References Cited

U.S. PATENT DOCUMENTS 5,194,943 A * 3/1993 Tomita et al. ..... 348/255
5,315,378 A * 5/1994 Satou et al. ..... 348/655
6,340,976 B1 * 1/2002 Oguchi et al. ..... 345/690
6,593,934 B1 * 7/2003 Liaw et al. ..... 345/590
6,950,098 B2 * 9/2005 Brabander et al. ..... 345/207
6,995,753 B2 * 2/2006 Yamazaki et al. ..... 345/204
7,002,594 B2 * 2/2006 Yoshida et al. ..... 345/600
7,170,535 B2 * 1/2007 Matsuda ..... 345/690
7,221,381 B2 * 5/2007 Brown et al. ..... 345/690
7,265,795 B2 * 9/2007 Ohyama et al. ..... 348/675
7,369,183 B2 * 5/2008 Oka et al. ..... 348/674
7,542,055 B2 * 6/2009 Matsuda et al. ..... 345/690
2005/0030271 A1 * 2/2005 Liu ..... 345/89
2005/0104877 A1 * 5/2005 Nakamura et al. ..... 345/207

FOREIGN PATENT DOCUMENTS

CN 1158531 A 9/1997
CN 1432987 A 7/2003

* cited by examiner

*Primary Examiner*—Richard Hjerpe
*Assistant Examiner*—Tom V Sheng
(74) *Attorney, Agent, or Firm*—Quintero Law Office, PC

(57) ABSTRACT

A brightness correction method for a display panel, comprising showing a plurality of image areas in the display panel, wherein the image areas display different colors, each color has a plurality of luminance values according to a plurality of gray values, and wherein each gray value corresponds to a gamma voltage; detecting the luminance values; and adjusting the gamma voltages according to the detected luminance values.

22 Claims, 2 Drawing Sheets

BRIGHTNESS CORRECTION METHOD AND SYSTEM UTILIZING THE SAME

BACKGROUND

The disclosure relates to a correction method and system, and more particularly to a brightness correction method and system.

Featuring the favorable advantages of thinness, lightness, and generating low radiation, liquid crystal displays (LCDs) have been widely used. Each LCD comprises a display panel including a number of pixels. The light transmittance of each pixel is determined by the voltage difference between the upper plate voltage and the lower plate voltage. The light transmittance of every pixel is typically non-linear with respect to the voltage applied across the pixel. Thus, gamma voltage correction is performed to reduce color distortion by adjusting the brightness of pixels of the display panel.

Generally, an image displayed in a display panel is constituted by three basic colors (RBG) such that the gamma voltages of each color must be respectively corrected. Thus a manufacturer must spend 10~15 minutes on gamma voltage correction in a display panel.

Since the gamma voltage correction for display panels is time-consuming, the manufacturer does not perform gamma voltage correction for every display panel. The manufacturer gives a standard gamma voltage group and then records the standard gamma voltage group in each display panel.

Since characteristics of display panels are different, as each display panel utilizes the standard gamma voltage group, aberration easily occurs in the display panels.

SUMMARY

Brightness correction methods are provided. An exemplary embodiment of a brightness correction method for a display panel comprises: showing a plurality of image areas on the display panel, wherein the image areas display different colors, each color having a plurality of luminance values according to a plurality of gray values, and wherein each gray value corresponds to a gamma voltage; detecting the luminance values; and adjusting the gamma voltages according to the detected luminance values.

The method may be implemented by software embodied on a computer readable storage medium.

An exemplary embodiment of a brightness correction system comprises a display panel, a brightness detector, and a processor. The display panel shows a plurality of image areas. The image areas have different colors. Each color has a plurality of luminance values according to a plurality of gray values. Each gray value corresponds to a gamma voltage. The brightness detector detects the luminance values. The processor adjusts the gamma voltages according to the detected luminance values.

BRIEF DESCRIPTION OF THE DRAWINGS

The invention can be more fully understood by reading the subsequent detailed description and examples with reference made to the accompanying drawings, wherein.

DETAILED DESCRIPTION

Figure 1:
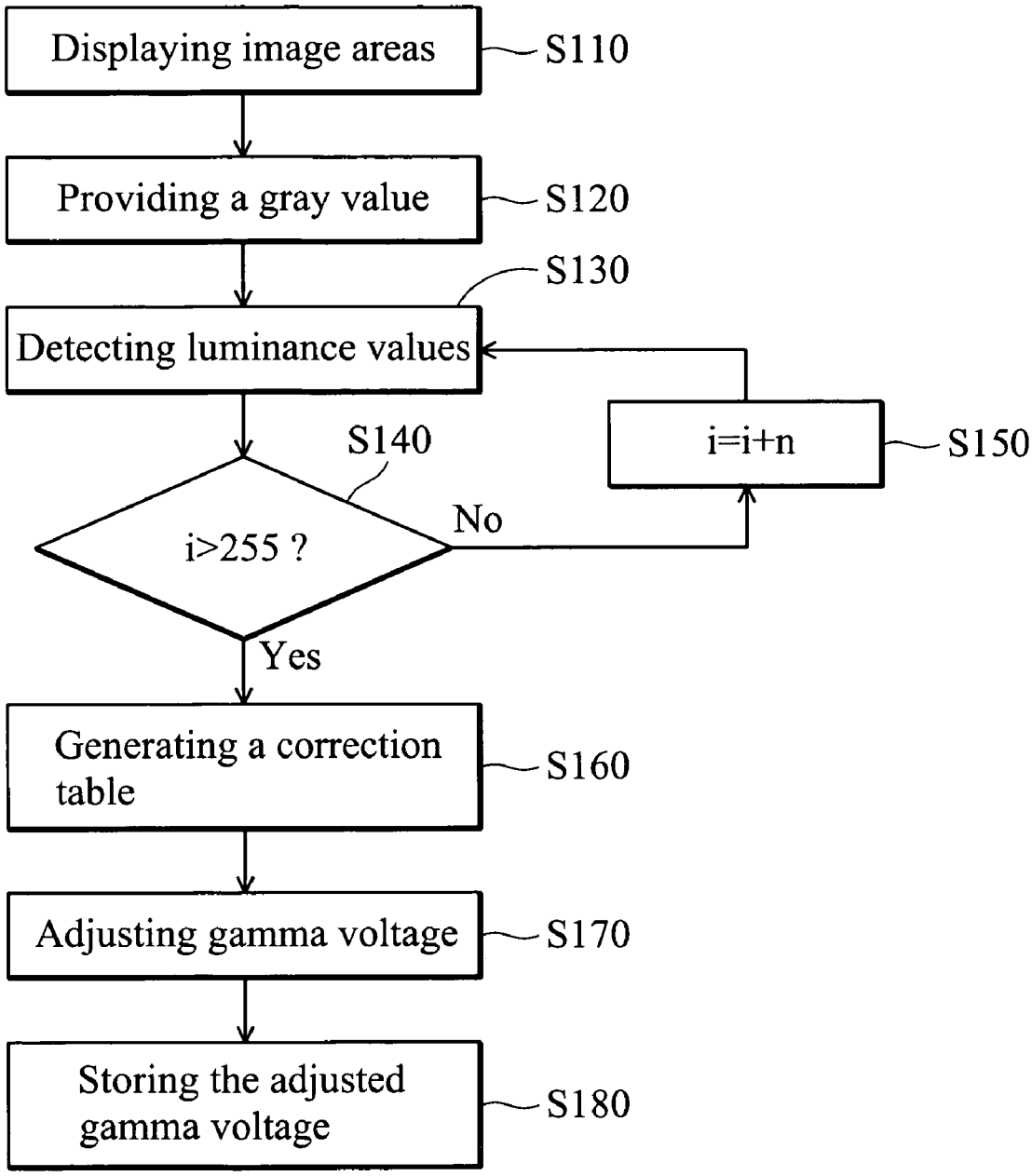
FIG. 1 is a flowchart of an exemplary embodiment of a brightness correction method.

FIG. 1 is a flowchart of an exemplary embodiment of a brightness correction method. The brightness correction method is applied to a display panel. The display panel receives an input signal group for showing image areas in step S110. The image areas display different colors. The input signal group is provided by a controller of the display panel or an external device for controlling the positions of the image areas and colors shown in the image areas. The external device provides the input signal group to the display panel through DVI (Digital Visual Interface).

Since an image displayed in the display panel is constituted by three basic colors (RBG), the display panel can show three image areas respectively displaying red, blue, and green or show two image areas respectively displaying red and green, green and blue, or red and blue. A display panel showing three image areas is given an example for describing the brightness correction method.

A first gray value is provided in step S120. If the display panel comprises a data driver having 8 bits, the number of gray values is 256. Each gray value corresponds to a gamma voltage. When the display panel receives the first gray value, each color in one image area generates a corresponding luminance value.

The luminance values of colors respectively displayed in three image areas are detected in step S130. Each luminance value can be detected by a test apparatus comprising a plurality of test terminals. To detect luminance values of colors showing in the image areas, each test terminal directly or indirectly contacts each image area. As each test terminal indirectly contacts each image area, a gap exists between each test terminal and each image area.

The first gray level is determined in step S140. If the first gray value is less than 255, the step S150 is executed for providing another gray value to the display panel for continuously detecting other luminance values.

In step S150, n is equal to 1 and the display panel can receive 256 gray values. When n is equal to 2, the display panel only receives 126 gray values. When n is smaller, the accuracy of the brightness correction method is higher. When n is larger, the correction time is shorter.

When the gray value is more than 255, a correction table is generated in step S160. The correction table records each detected luminance value and the corresponding gray value. Since each gray value corresponds to one gamma voltage, as the gamma voltage is adjusted, the gray value and the luminance value are changed. Thus a manufacturer adjusts the gamma voltages according to the detected luminance values in step S170, such that a new luminance value can be generated.

The adjusted gamma voltages are stored in a storage device in step S190. The adjusted gamma voltages can be stored in a memory, such as EEPROM, within the display panel.

Since the luminance values of colors respectively displayed in image areas are recorded in the correction table, the manufacturer can adjust the gamma voltages according to different requirements of users for changing the luminance values.

Additionally, the brightness correction method can be applied to software for correcting the brightness of the display panel.

Figure 2:
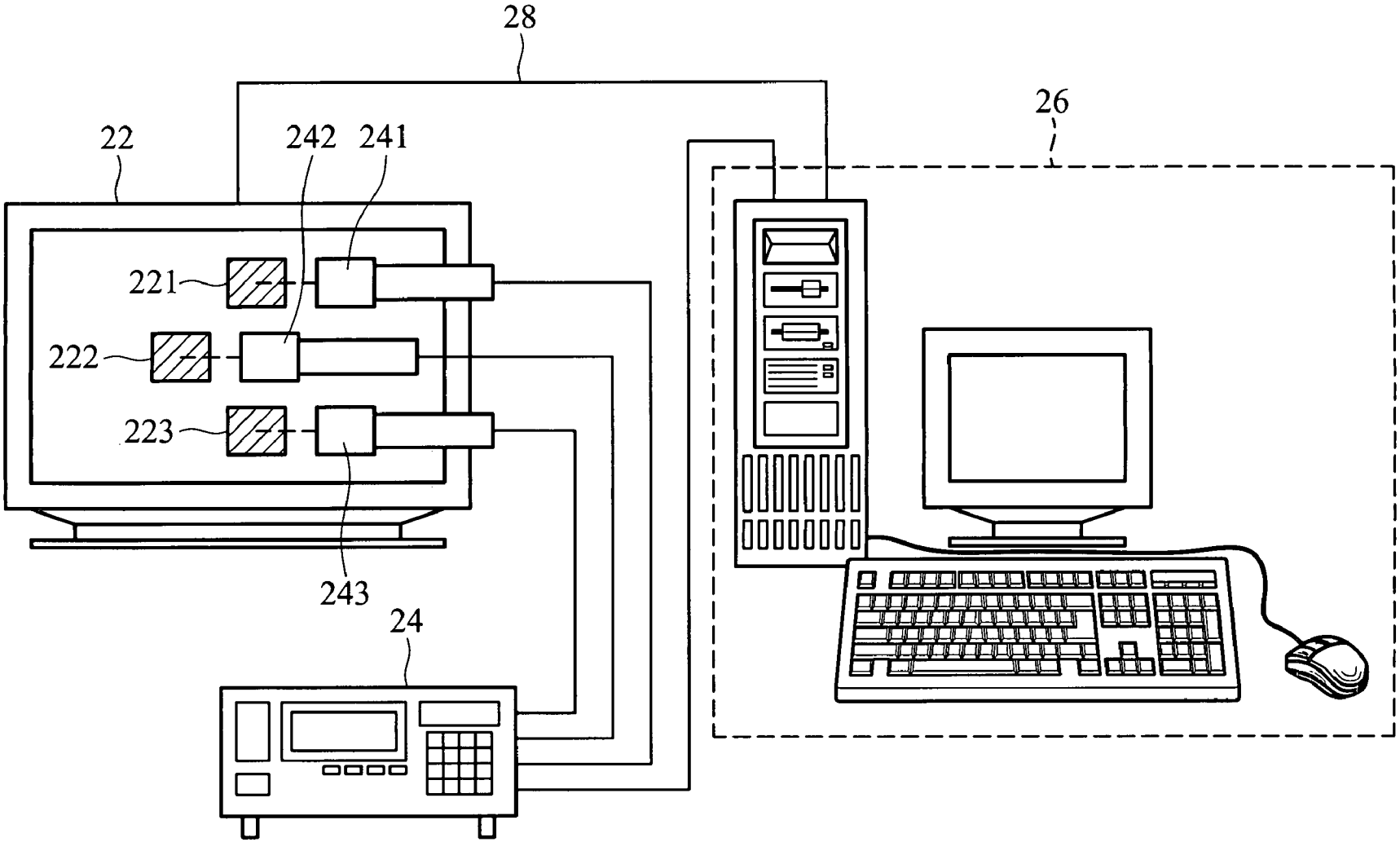
FIG. 2 is a schematic diagram of exemplary embodiment of a brightness correction system.

FIG. 2 is a schematic diagram of exemplary embodiment of a brightness correction system. The brightness correction system comprises a display panel 22, a brightness detector 24, and a processor 26.

Display panel 22 displays image areas 221~223. Since an image is constituted by three basic colors (RBG), the colors displayed in image areas 221~223 are respectively red, blue, and green. The display panel can display two image areas displaying red and green, green and blue, or red and blue for reducing correction time.

Brightness detector 24, such as an optical spectrum analyzer, comprises test terminals 241~243 for detecting the luminance values of image areas 221~223. The color displayed in image areas 221~223 respectively have a plurality of the luminance values according to different gray values. Each gray value corresponds to a gamma voltage. The test terminals 241~243 directly or indirectly contact the image areas 221~223. When the test terminals 241~243 respectively and indirectly contact the image areas 221~223, a gap exists between each test terminal and each image area. Shown as FIG. 2, the test terminals 241~243 are respectively directly contacts the image areas 221~223.

Processor 26, such as a tablet computer, adjusts the gamma voltages according to the detected luminance values detected by brightness detector 24 for changing luminance values. The adjusted gamma voltages can be stored in a storage device (EEPROM) within the display panel 22.

Additionally, processor 26 provides an input signal group to display panel 22 through a DVI cable 28 for defining the positions of the image areas 221~223 and colors displayed in the image areas 221~223.

The operating principle of the brightness correction system is shown in FIG. 2 and described in the following. Processor 26 is coupled to display panel 22 through a DVI cable for defining the positions of image areas 221~223. Processor 26 provides a gray value to display panel 22 such that image areas 221~223 display different colors. Each color has a luminance value.

Test terminals 241~243 of brightness detector 24 directly contact image areas 221~223 for detecting luminance values of colors displayed in image areas 221~223 and then outputs the detected luminance values to processor 26 such that processor 26 provides another gray value.

Processor 26 records the detected luminance values and the corresponding gray values in a correction table (look up table). The manufacturer adjusts the gamma voltages corresponding to the recorded gray values in the correction table according to users requirements. The adjusted gamma voltages can be stored in a stored device (not shown) within display panel 22.

Since the luminance values of colors displayed in image areas are detected simultaneously, the correction time can be reduced to 2 minutes. When the processor continuously provides five gray values and then the brightness detector detects brightness once, the correction time is reduced. Thus, operation of gamma voltage correction can be executed for each display panel in the manufacturing such that aberrations can be reduced.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A brightness correction method for a display panel, comprising:

providing a plurality of gray values in a sequence, wherein each gray value corresponds to a gamma voltage;

for each gray value provided, showing in turn a plurality of image areas in the display panel, wherein the plurality of image areas are defined according to an input signal group, wherein the display panel receives the input signal group, and wherein the image areas display different colors, and each color has a luminance value according to the provided gray value;

detecting in turn the luminance values of the colors showing in the image areas for each gray value provided; and adjusting the gamma voltages according to the detected luminance values.

2. The brightness correction method as claimed in claim 1, wherein the positions of the image areas and colors displayed in the image areas are defined by the input signal group.

3. The brightness correction method as claimed in claim 2, wherein the external device is coupled to the display panel through a digital visual interface (DVT).

4. The brightness correction method as claimed in claim 1, wherein the input signal group is provided by an external device.

5. The brightness correction method as claimed in claim 1, wherein the input signal group is provided by a control device of the display panel.

6. The brightness correction method as claimed in claim 1, wherein the luminance values are detected by a test apparatus comprising a plurality of test terminals, and wherein each test terminal directly contacts each image area.

7. The brightness correction method as claimed in claim 1, wherein the luminance values are detected by a test apparatus comprising a plurality of test terminals, and wherein each image area indirectly contacts each test terminal.

8. The brightness correction method as claimed in claim 1, wherein the adjusted gamma voltages are stored in a correction table.

9. The brightness correction method as claimed in claim 8, wherein the correction table is recorded in a storage device.

10. The brightness correction method as claimed in claim 9, wherein the storage device is located in the display panel.

11. The brightness correction method as claimed in claim 9, wherein the storage device is an EEPROM.

12. The brightness correction method as claimed in claim 1, wherein the colors shown in the image areas are red, green, and blue, respectively.

13. A software, embodied in a computer readable storage medium, for executing the brightness correction method as claimed in claim 1.

14. A brightness correction system comprising:

a display panel for showing a plurality of image areas, wherein the image areas have different colors, each color has a plurality of luminance values according to a plurality of gray values provided in a sequence, wherein each gray value corresponds to a gamma voltage;

a brightness detector detecting in turn the luminance values of the colors showing in the image areas for each gray value provided; and a processor adjusting the gamma voltages according to the detected luminance values, wherein the processor provides an input signal group to the display panel for defining the image areas.

15. The brightness correction system as claimed in claim 14, wherein the input signal group defines positions of the image areas and colors displayed in the image areas.

16. The brightness correction system as claimed in claim 14, wherein the processor is coupled to the display panel through a DVI interface.

17. The brightness correction system as claimed in claim 14, wherein the display panel comprises a control device for providing the input signal group.

18. The brightness correction system as claimed in claim 14, wherein the brightness detector comprises a plurality of test terminals for detecting the luminance values and wherein each test terminal directly contacts each image area.

19. The brightness correction system as claimed in claim 14, wherein the brightness detector comprises a plurality of test terminals for detecting the luminance values and each test terminal indirectly contacts each image area.

20. The brightness correction system as claimed in claim 14, wherein the display panel further comprises a storage device for storing the adjusted gamma voltages.

21. The brightness correction system as claimed in claim 20, wherein the storage device is an EEPROM.

22. The brightness correction system as claimed in claim 14, wherein the colors shown in the image areas are red, green, and blue, respectively.

* * * * *